US009915100B2

(12) United States Patent
Mahajan et al.

(10) Patent No.: US 9,915,100 B2
(45) **Date of Patent: *Mar. 13, 2018**

(54) UNDERREAMER FOR INCREASING A BORE DIAMETER

(71) Applicant: SMITH INTERNATIONAL, INC., Houston, TX (US)

(72) Inventors: Manoj D. Mahajan, Houston, TX (US); Daniel W. Brietzke, Spring, TX (US); Nathan E. Fuller, Spring, TX (US); James A. Barnhouse, Houston, TX (US); Georges Ishak, Houston, TX (US)

(73) Assignee: SMITH INTERNATIONAL, INC., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/539,612

(22) Filed: Nov. 12, 2014

(65) Prior Publication Data

US 2015/0184462 A1 Jul. 2, 2015

Related U.S. Application Data

(60) Provisional application No. 61/921,050, filed on Dec. 26, 2013.

(51) Int. Cl.

| | |
|---|---|
| ***E21B 7/28*** | (2006.01) |
| ***E21B 3/00*** | (2006.01) |
| ***E21B 10/32*** | (2006.01) |

(52) U.S. Cl.

CPC ..... *E21B 7/28* (2013.01); *E21B 3/00* (2013.01); *E21B 10/322* (2013.01)

(58) Field of Classification Search

CPC ..... E21B 7/28; E21B 10/26; E21B 10/322; E21B 3/00

See application file for complete search history.

(56) References Cited

U.S. PATENT DOCUMENTS

| | | | | |
|---|---|---|---|---|
| 4,282,942 | A | 8/1981 | Longmore | |
| 4,354,560 | A | 10/1982 | Johnson | |
| 4,565,252 | A | 1/1986 | Campbell et al. | |
| 6,732,817 | B2 | 5/2004 | Dewey et al. | |
| 7,036,611 | B2 * | 5/2006 | Radford | E21B 10/322 175/296 |

(Continued)

FOREIGN PATENT DOCUMENTS

| | | | |
|---|---|---|---|
| GB | 2401384 | A | 11/2004 |
| WO | 2004101943 | A3 | 11/2001 |

(Continued)

OTHER PUBLICATIONS

International Search Report and Written Opinion issued in PCT/US2014/066127 on May 8, 2015, 17 pages.

International Preliminary Report on Patentability issued in related PCT application PCT/US2014/066127 on Jul. 7, 2016, 14 pages.

Search Report under R. 61 or R. 63 EPC issued in European Patent Application No. EP 13868680.3 dated Oct. 6, 2016, 4 pages.

International Search Report and Written Opinion issued in International Patent Application No. PCT/US2013/078078 dated Apr. 22, 2014, 17 pages.

(Continued)

*Primary Examiner* — Cathleen Hutchins
*Assistant Examiner* — Ronald Runyan

(57) ABSTRACT

An underreamer for increasing the diameter of a bore. The underreamer includes a substantially cylindrical body. A mandrel may extend axially through the body. One or more cutter blocks are movably coupled to the body. A ratio of a height of the cutter block to a diameter of the body is between about 0.35:1 and about 0.50:1.

25 Claims, 7 Drawing Sheets

(56) References Cited

U.S. PATENT DOCUMENTS

| | | | | |
|---|---|---|---|---|
| 7,108,082 | B1 | 9/2006 | Anthony et al. | |
| 7,673,708 | B2 | 3/2010 | Lee | |
| 8,555,983 | B2 | 10/2013 | Palacios | |
| 2005/0241856 | A1 | 11/2005 | Lassoie et al. | |
| 2005/0274546 | A1* | 12/2005 | Fanuel | E21B 10/32 175/57 |
| 2007/0062706 | A1 | 3/2007 | Leising | |
| 2007/0163808 | A1* | 7/2007 | Campbell | E21B 10/322 175/57 |
| 2010/0200298 | A1 | 8/2010 | MacKenzie | |
| 2011/0073371 | A1 | 3/2011 | Radford et al. | |
| 2011/0127044 | A1 | 6/2011 | Radford et al. | |
| 2012/0031615 | A1 | 2/2012 | Connell et al. | |
| 2012/0073879 | A1 | 3/2012 | Makkar et al. | |
| 2012/0080228 | A1 | 4/2012 | Radford et al. | |
| 2012/0080231 | A1 | 4/2012 | Radford et al. | |
| 2012/0080233 | A1 | 4/2012 | Hall et al. | |
| 2012/0298423 | A1 | 11/2012 | Cruickshank et al. | |
| 2013/0175095 | A1 | 7/2013 | Dewey et al. | |
| 2013/0206401 | A1 | 8/2013 | Bhoite et al. | |
| 2013/0256034 | A1 | 10/2013 | Poteet et al. | |
| 2014/0131109 | A1 | 5/2014 | Mahajan et al. | |
| 2014/0182940 | A1 | 7/2014 | Mahajan et al. | |
| 2014/0246246 | A1 | 9/2014 | Radford | |

FOREIGN PATENT DOCUMENTS

| | | | |
|---|---|---|---|
| WO | 03102354 | A1 | 12/2003 |
| WO | WO2005094166 | A2 | 10/2005 |

OTHER PUBLICATIONS

International Preliminary Report on Patentability issued in International Patent Application No. PCT/US2014/078078 dated Jul. 9, 2015, 14 pages.

International Preliminary Report on Patentability issued in International Patent Application No. PCT/US2015/034828 dated Dec. 22, 2016, 8 pages.

International Search Report and Written Opinion issued in International Patent Application No. PCT/US2015/034828 dated Aug. 28, 2015, 9 pages.

Office Action issued in U.S. Appl. No. 14/141,796 dated Apr. 6, 2016, 13 pages.

Office Action issued in U.S. Appl. No. 14/141,796 dated Oct. 14, 2016, 11 pages.

Office Action issued in U.S. Appl. No. 14/732,980 dated Jul. 27, 2017, 11 pages.

* cited by examiner

UNDERREAMER FOR INCREASING A BORE DIAMETER

CROSS-REFERENCE TO RELATED APPLICATIONS

The present application claims priority to U.S. Provisional Application 61/921,050, filed Dec. 26, 2013, the entirety of which is included by reference.

FIELD OF THE INVENTION

Aspects relate to downhole tools for drilling. More specifically, aspects relate to underreamer technology used to increase bore diameter.

BACKGROUND INFORMATION

After a wellbore is drilled, an underreamer is oftentimes used to enlarge the diameter of the wellbore. Conventional underreamers have a body with a mandrel extending axially therethrough. The mandrel has an axial bore through which fluid flows. One or more cutter blocks are movably coupled to the body and adapted to transition from a retracted state to an expanded state.

The underreamer is run into the wellbore in the retracted state. In the retracted state, the cutter blocks are folded into the body of the underreamer such that the cutter blocks are positioned radially-inward from the surrounding casing or wellbore wall. Once the underreamer reaches the desired depth in the wellbore, the underreamer is actuated into the expanded state. In the expanded state, the cutter blocks move radially-outward and into contact with the wellbore wall. The cutter blocks are then used to cut or grind the wall of the wellbore to increase the diameter thereof.

The (radial) height of the cutter blocks is less than or equal to the (radial) distance between the outer surface of the mandrel and the outer surface of the body. As the height of the cutter blocks increases, so may the amount by which the cutter blocks are adapted to increase the diameter of the wellbore when in the expanded state. Conventional cutter blocks are adapted to increase the diameter of the wellbore between about 15% and about 25% from the original (i.e., pilot hole) diameter. When a larger increase in the wellbore diameter is desired, the first underreamer is pulled out of the wellbore, and a second, larger underreamer is run into the wellbore to further increase the diameter of the wellbore. Running multiple underreamers into the wellbore is a time-consuming process, which can lead to lost profits in the field.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

An underreamer for increasing a diameter of a bore is disclosed. The underreamer includes a substantially cylindrical body. A mandrel may extend axially through the body. A cutter block is movably coupled to the body. A ratio of a height of the cutter block to a diameter of the body is between about 0.35:1 and about 0.50:1.

The underreamer may also include a substantially cylindrical body having a flow channel extending at least partially axially therethrough. A mandrel may extend axially through the body. The flow channel is disposed radially between the mandrel and an outer surface of the body. A cutter block is movably coupled to the body. An outer surface of the cutter block is positioned radially inward from or radially aligned with the outer surface of the body when the cutter block is in a retracted state, and the outer surface of the cutter block is positioned radially outward from the outer surface of the body by a distance when the cutter block is in an expanded state. A ratio of a height of the cutter block to a diameter of the body is between about 0.35:1 and about 0.50:1.

A method for increasing a diameter of a bore is also disclosed. The method includes running an underreamer into a bore. The underreamer includes a substantially cylindrical body having a mandrel extending at least partially axially therethrough. A cutter block movably coupled to the body moves from a retracted state to an expanded state. An outer surface of the cutter block is positioned radially inward from or radially aligned with an outer surface of the body when the cutter block is in the retracted state, and the outer surface of the cutter block is positioned radially outward from the outer surface of the body by a distance when the cutter block is in the expanded state. A ratio of a height of the cutter block to a diameter of the body is between about 0.35:1 and about 0.50:1. The cutter block increases the diameter of the bore when the cutter block is in the expanded state.

BRIEF DESCRIPTION OF THE DRAWINGS

So that the recited features may be understood in detail, a more particular description, briefly summarized above, may be had by reference to one or more implementations, some of which are illustrated in the appended drawings. It is to be noted, however, that the appended drawings are illustrative implementations, and are, therefore, not to be considered limiting of its scope.

DETAILED DESCRIPTION

Figure 1:
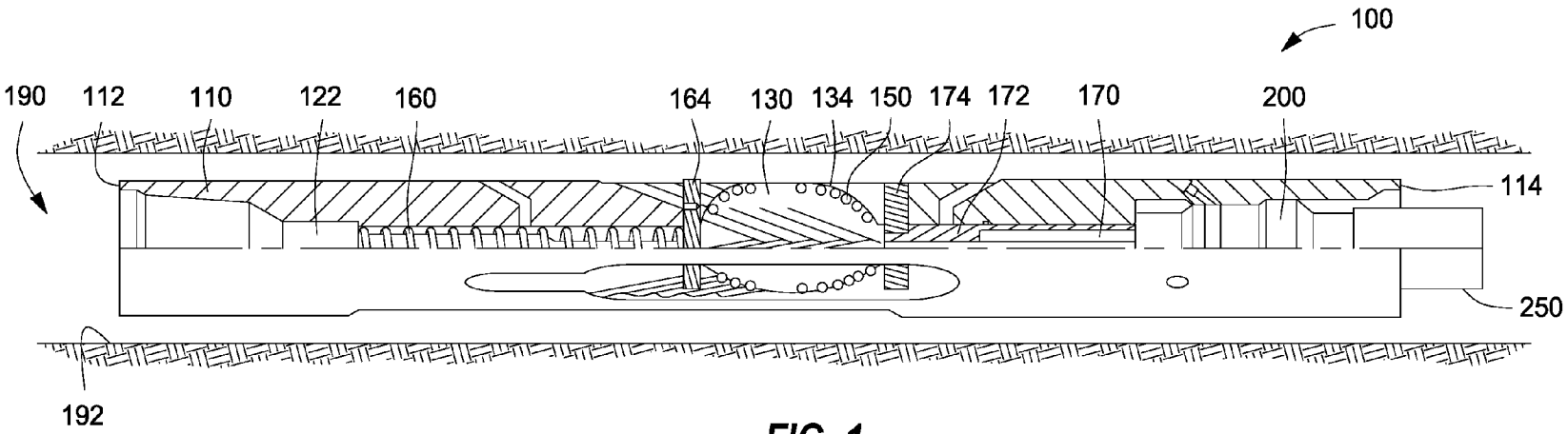
FIG. 1 depicts a side view, which is partially cutaway, of an illustrative underreamer having one or more cutter blocks in a retracted state, according to one or more implementations disclosed.
Figure 2:
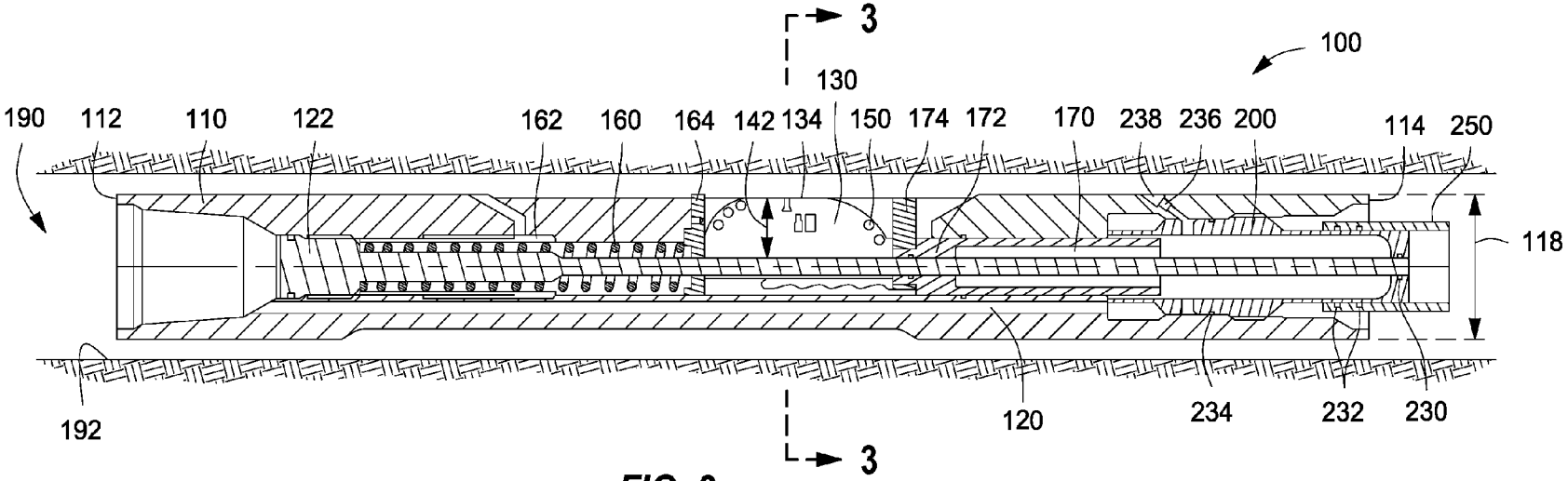
FIG. 2 depicts a cross-sectional side view of the underreamer shown in FIG. 1, according to one or more implementations disclosed.
Figure 3:
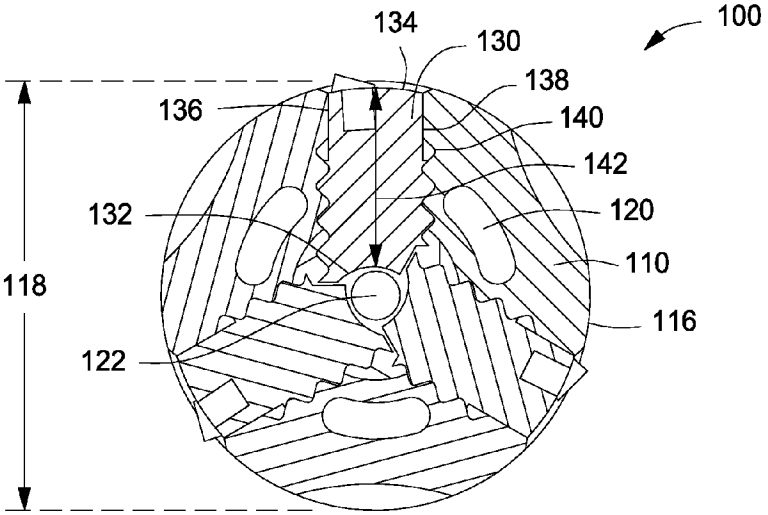
FIG. 3 depicts a cross-sectional view through the cutter blocks of the underreamer shown in FIG. 1, according to one or more implementations disclosed.

FIG. 1 depicts a side view of an illustrative underreamer 100 (with a portion removed for clarity) having one or more cutter blocks 130 in a retracted state, FIG. 2 depicts a cross-sectional side view of the underreamer 100, and FIG. 3 depicts a cross-sectional view through the cutter blocks 130 of the underreamer 100, according to one or more implementations. The underreamer 100 is adapted to increase a diameter of wellbore 190. Those skilled in the art will readily appreciate that the underreamer 100 described herein may alternatively be a reamer, hole opener or other downhole tool with secondary cutting structures. As used herein, the wellbore 190 may be a well, a bore, a borehole or any drilled subterranean tunnel.

The underreamer 100 includes a substantially cylindrical body 110 having a first or "upper" end portion 112 and a second or "lower" end portion 114. In at least one implementation, the body 110 has a cross-sectional length or diameter ranging from a low of about 5 cm, about 7.5 cm, about 10 cm, or about 12.5 cm to a high of about 15 cm, about 20 cm, about 25 cm, about 30 cm, or more. For example, the diameter of the body 110 may be between about 7.5 cm and about 17.5 cm, between about 10 cm and about 15 cm, or between about 12 cm and about 13.5 cm.

An inner mandrel 122 may extend axially through the center of the body 110. The mandrel 122 may be a solid rod (i.e., no axial bore formed therethrough). In another implementation, the mandrel 122 may have an axial bore formed at least partially (or completely) therethrough. The portion of the mandrel 122 positioned radially inward from the cutter blocks 130 (introduced below and illustrated in FIG. 2) may have a cross-sectional diameter (i.e., cross-sectional length) ranging from a low of about 5 mm, about 10 mm, or about 15 mm to a high of about 20 mm, about 25 mm, about 30 mm, or more. For example, the portion of the mandrel 122 positioned radially inward from the cutter blocks 130 may have a diameter between about 5 mm and about 25 mm, between about 5 mm and about 20 mm, or between about 8 mm and about 15 mm.

A ratio of the diameter of the mandrel 122 (i.e., the portion of the mandrel 122 positioned radially inward from the cutter blocks 130) to the diameter of the body 110 may range from a low of about 1:2, about 1:4, about 1:6, about 1:8, or about 1:10 to a high of about 1:12, about 1:14, about 1:16, about 1:18, about 1:20, or more. For example, the ratio may be between about 1:5 and about 1:20, between about 1:5 and about 1:15, or between about 1:8 and about 1:12.

As illustrated in FIG. 3, one or more flow channels 120 may extend axially through the body 110. The flow channels 120 may be disposed radially between an outer surface of the mandrel 122 and an outer surface 116 of the body 110. The flow channels 120 may be circumferentially offset from one another by between about 30° and about 60°, between about 60° and about 90°, between about 90° and about 120°, between about 120° and about 150°, or between about 150° and about 180°. For example, the flow channels 120 may be circumferentially offset from one another by between about 110° and about 130°, as shown. The flow channels 120 may be disposed circumferentially between adjacent cutter blocks 130. While three flow channels 120 are shown, it may be appreciated that the number of flow channels 120 may range from a low of 1, 2, 3, or 4 to a high of 6, 8, 10, 12, or more.

The flow channels 120 (individually) may have a cross-sectional area ranging from a low of about 0.5 $cm^2$, about 1 $cm^2$, about 2 $cm^2$, about 3 $cm^2$, about 4 $cm^2$, or about 5 $cm^2$ to a high of about 6 $cm^2$, about 8 $cm^2$, about 10 $cm^2$, about 15 $cm^2$, or more. For example, the flow channels 120 (individually) may have a cross-sectional area between about 1 $cm^2$ and about 15 $cm^2$, between about 1 $cm^2$ and about 10 $cm^2$, or between about 1 $cm^2$ and about 5 $cm^2$. As such, the cross-sectional area of the flow channels 120 (in sum or total) may be between about 3 $cm^2$ and about 45 $cm^2$, between about 3 $cm^2$ and about 30 $cm^2$, or between about 3 $cm^2$ and about 15 $cm^2$.

The body 110 may have an erosion resistant coating on a surface thereof defining the flow channels 120 to reduce erosion of the body 110 when fluid flows through the flow channels 120 at a high velocity. In another implementation, an erosion protection sleeve (not shown) may be disposed in each of the flow channels 120. The erosion protection sleeve may have an axial bore through which the fluid may pass. The protection sleeve may be made of a hard material, such as carbide, or may be itself covered with an erosion resistant coating.

Figure 4:
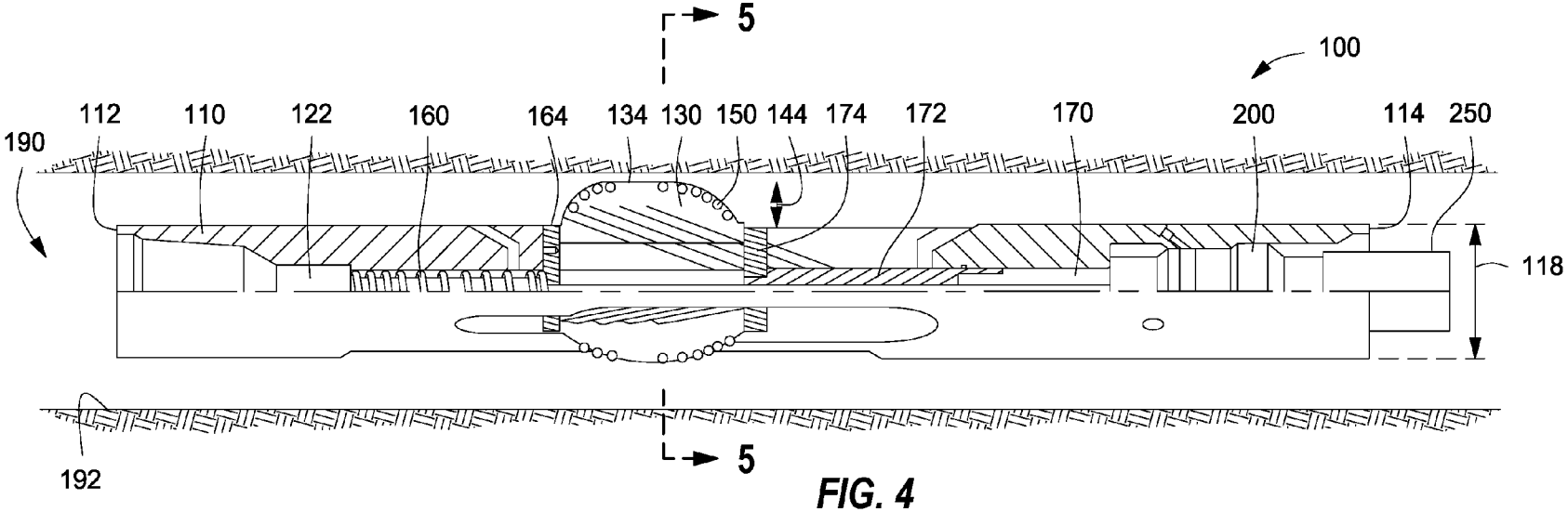
FIG. 4 depicts a side view, which is partially cutaway, of the underreamer having the cutter blocks in an expanded state, according to one or more implementations disclosed.

As illustrated in FIG. 4, one or more cutter blocks 130 are movably coupled to the body 110. As shown, three cutter blocks 130 are circumferentially offset from one another around the body 110 and the mandrel 122 by between about 110° and about 130°. While three cutter blocks 130 are shown, it may be appreciated that the number of cutter blocks 130 may range from a low of 1, 2, 3, or 4 to a high of 6, 8, 10, 12, or more. An illustrative underreamer having a cutter block movably coupled thereto is shown and described in U.S. Pat. No. 6,732,817, filed Feb. 19, 2002, titled "Expandable Underreamer/Stabilizer," to Dewey et al., the content of which is incorporated by reference herein to the extent consistent with the present disclosure.

The cutter blocks 130 each have a plurality of cutting compacts or elements 150 disposed on an outer (radial) surface 134 thereof. In at least one implementation, the cutting elements 150 of the cutter blocks 130 may include polycrystalline diamond compacts ("PDCs") or the like. The number, size, shape, and orientation of the cutting elements 150 is illustrative, and other configurations are also contemplated. The cutting elements 150 on the cutter blocks 130 are adapted to cut or grind the wall 192 of the wellbore 190 to increase the diameter thereof when the underreamer 100 is in an expanded state, as described in more detail below.

The cutter blocks 130 may also have a plurality of stabilizing pads or inserts (not shown) disposed on the outer surface 134 thereof. In at least one implementation, the stabilizing inserts on the cutter blocks 130 may be or include tungsten carbide inserts, or the like. The stabilizing inserts are adapted to absorb and reduce vibration between the cutter blocks 130 and the wall 192 of the wellbore 190.

Returning to FIG. 3, the cutter blocks 130 have a plurality of splines or extensions 140 formed on the outer (side) surfaces 136, 138 thereof. The splines 140 may be or include offset ridges or protrusions adapted to engage corresponding grooves or channels 146 in the body 110. The splines 140 on the cutter blocks 130 (and the corresponding grooves 146)

are oriented at an angle with respect to a longitudinal axis through the body 110. The angle may range from a low of about 10°, about 15°, or about 20° to a high of about 25°, about 30°, about 35°, or more. For example, the angle may be between about 15° and about 25°, or about 17° and about 23°.

In at least one implementation, the non-loaded side surface 136 of the cutter blocks 130 may have a portion removed proximate the inner surface 132 to allow the cutter blocks 130 to collapse further into the body 110 when the cutter blocks 130 are in the retracted state. In at least one implementation, the loaded side surface 138 may not have a portion removed so that the load carrying capability of the cutter blocks 130 is not compromised when the cutter blocks 130 are in the expanded state.

The cutter blocks 130 may have a height 142 (measured radially from the inner surface 132 to the outer surface 134) ranging from a low of about 30 mm, about 35 mm, about 40 mm, or about 45 mm to a high of about 50 mm, about 55 mm, about 60 mm, about 65 mm, or more. For example, the height 142 of the cutter blocks 130 may be between about 40 mm and about 65 mm, between about 45 mm and about 60 mm, or between about 45 mm and about 55 mm. A ratio of the height 142 of the cutter blocks 130 to the diameter 118 of the body 110 may range from a low of about 0.25:1, about 0.30:1, or about 0.35:1 to a high of about 0.40:1, about 0.45:1, about 0.50:1, or more. For example, the ratio of the height 142 of the cutter blocks 130 to the diameter 118 of the body 110 may be between about 0.30:1 and about 0.50:1, between about 0.32:1 and about 0.50:1, between about 0.34:1 and about 0.50:1, between about 0.36:1 and about 0.50:1, between about 0.38:1 and about 0.50:1, between about 0.40:1 and about 0.50:1, or between about 0.35:1 and about 0.45:1.

The cutter blocks 130 shown in FIGS. 1 through 3 are in an inactive or retracted state. When the cutter blocks 130 are in the retracted state, the inner surface 132 of the cutter blocks 130 may be in contact with the mandrel 122, or the inner surface 132 of the cutter blocks 130 is radially offset from the mandrel 122 by less than about 5 mm, less than about 4 mm, less than about 3 mm, less than about 2 mm, or less than about 1 mm. Moreover, when the cutter blocks 130 are in the retracted state, the outer surface 134 of the cutter blocks 130 is positioned radially inward from or radially aligned with the outer surface 116 of the body 110. As such, the cutter blocks 130 may be spaced apart from the surrounding casing (not shown) and/or wall 192 of the wellbore 190 when in the retracted state.

A spring 160 may be disposed axially between the first end portion 112 of the body 110 and the cutter blocks 130 and radially between the body 110 and the mandrel 122. A spring retainer 162 may be disposed radially outward from the spring 160. A stop ring 164 may be disposed axially between the spring 160 and the cutter blocks 130 and radially outward from the mandrel 122. In at least one implementation, the stop ring 164 may be adapted to move or slide axially with respect to the body 110 and the mandrel 122.

An annular chamber 170 is disposed axially between the cutter blocks 130 and the second end portion 114 of the body 110 and radially between the body 110 and the mandrel 122. A piston 172 is disposed axially between the cutter blocks 130 and the chamber 170. A drive ring 174 is disposed axially between the cutter blocks 130 and the piston 172 and is coupled to the piston 172. The piston 172 and the drive ring 174 are adapted to move or slide axially with respect to the body 110 and the mandrel 122.

As illustrated in FIG. 2, a lower cap 200 may be disposed radially between the body 110 and the chamber 170. The lower cap 200 is shown and described in greater detail in FIGS. 6-8 below. An annular sleeve 250 may be disposed radially outward from the lower cap 200. The sleeve 250 may be adapted to move or slide axially with respect to the lower cap 200 (and the body 110).

One or more seals (one is shown 230) may be disposed radially between the mandrel 122 and the lower cap 200. The seal 230 may be a static seal as there is no relative movement between the lower cap 200 and the mandrel 122. One or more seals (two are shown 232) may be disposed radially between the lower cap 200 and the sleeve 250. The seals 232 may be dynamic seals as the sleeve 250 moves with respect to the lower cap 200. Additionally, one or more seals (one is shown 234) may be disposed between the lower cap 200 and the body 110, and one or more seals (one is shown 236) may be disposed in a nozzle 238 disposed or formed in the body 110.

Figure 5:
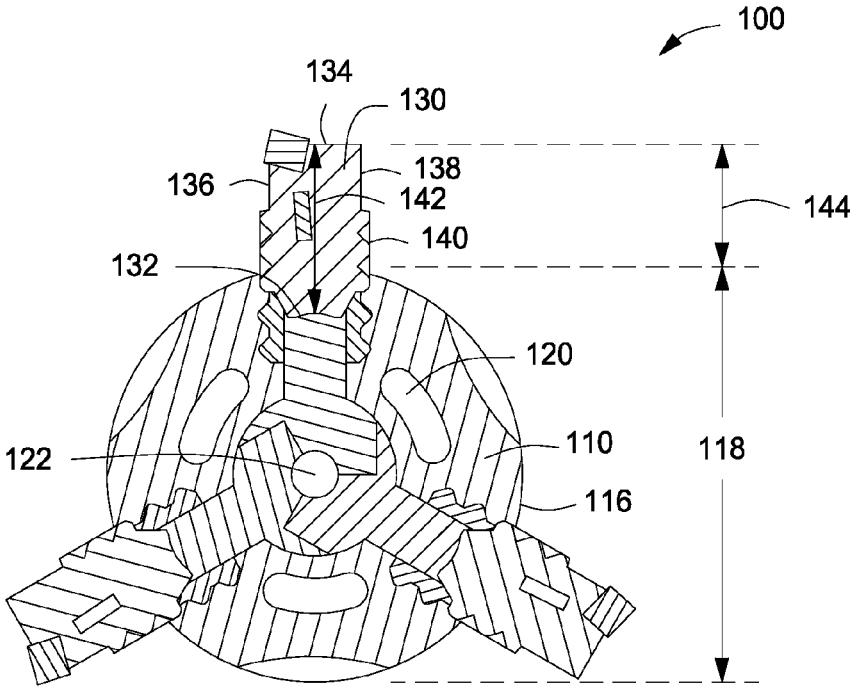
FIG. 5 depicts a cross-sectional view through the cutter blocks of the underreamer shown in FIG. 4, according to one or more implementations disclosed.

FIG. 4 depicts a side view of the underreamer 100 having the cutter blocks 130 in an active or expanded state, and FIG. 5 depicts a cross-sectional view through the cutter blocks 130 of the underreamer 100 shown in FIG. 4, according to one or more implementations. When an axial force is exerted on the cutter blocks 130 in a direction toward the first end portion 112 of the body 110 (as discussed below), the sliding engagement of the splines 140 of the cutter blocks 130 with the grooves 146 in the body 110 cause the cutter blocks 130 to simultaneously move radially outward and axially toward the first end portion 112 of the body 110. The resultant movement may be at an angle between about 15° and about 25° with respect to the longitudinal axis through the body 110. This movement transitions the cutter blocks 130 into the expanded state.

When the cutter blocks 130 are in the expanded state, the outer surface 134 of the cutter blocks 130 is positioned radially outward from the outer surface 116 of the body 110 by a distance 144. A ratio of the distance 144 to the diameter 118 of the body 110 may range from a low of about 0.10:1, about 0.15:1, or about 0.20:1 to a high of about 0.25:1, about 0.30:1, about 0.35:1, or more. For example, the ratio of the distance 144 to the diameter 118 of the body 110 may be between about 0.10:1 and about 0.35:1, between about 0.15:1 and about 0.30:1, or between about 0.20:1 and about 0.30:1, between about 0.30:1 and about 0.40:1, and between about 0.40:1 and about 0.50:1. As such, the when the cutter blocks 130 are in the expanded state, the cutter blocks 130 may be in contact with the wall 192 of the wellbore 190 and adapted to increase the diameter thereof from a low of about 20%, about 30%, or about 40% to a high of about 50%, about 60%, about 70%, or more. For example, the cutter blocks 130 may be adapted to increase the diameter of the wall 192 of the wellbore 190 between about 30% and about 70%, between about 35% and about 65%, or between about 40% and about 60%.

Figure 6:
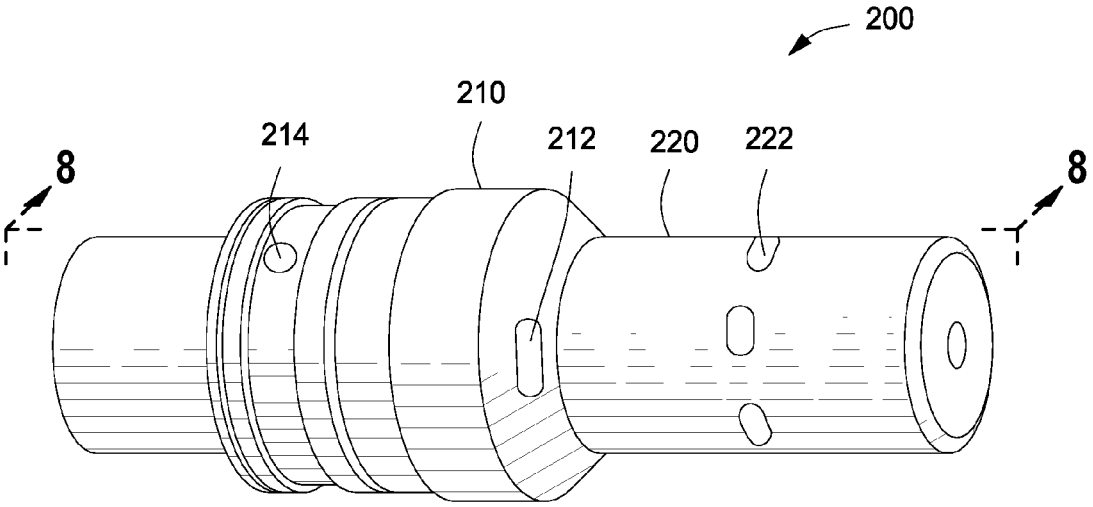
FIG. 6 depicts a perspective view of the lower cap, according to one or more implementations disclosed.
Figure 7:
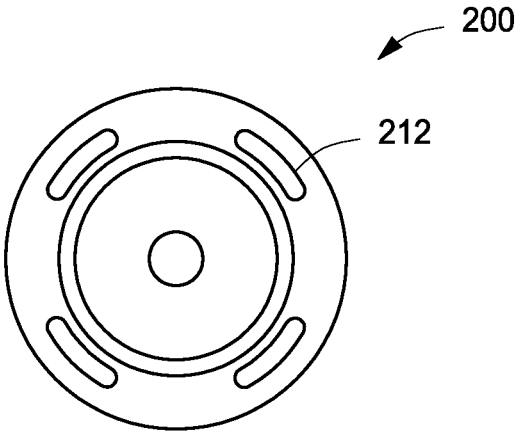
FIG. 7 depicts an end view of the lower cap shown in FIG. 6, according to one or more implementations.
Figure 8:
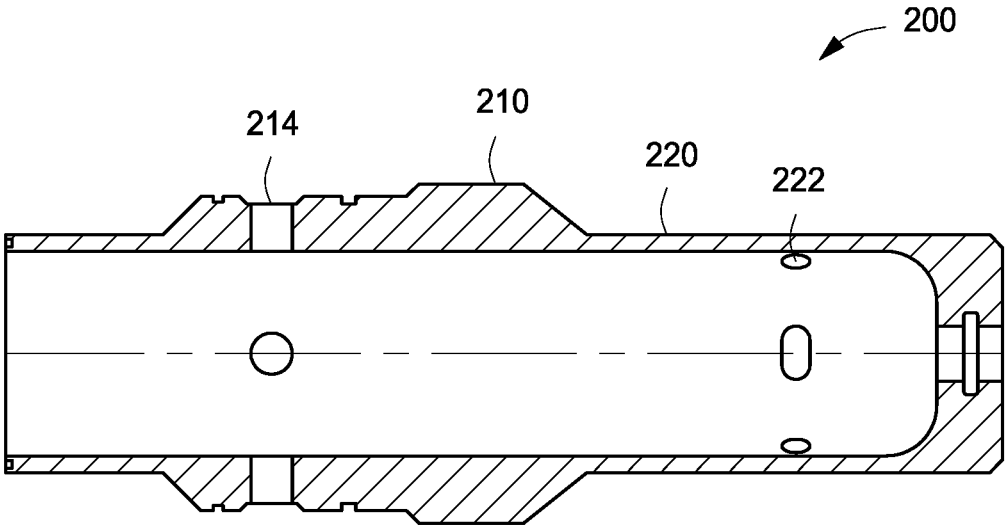
FIG. 8 depicts a cross-sectional side view of the lower cap shown in FIG. 6, according to one or more implementations.

FIG. 6 depicts a perspective view of the lower cap 200, and FIGS. 7 and 8 depict end portion and cross-sectional side views, respectively, of the lower cap 200 shown in FIG. 6, according to one or more implementations. The lower cap 200 may include first and second portions 210, 220 that are axially offset from one another. The first portion 210 may have a greater diameter than the second portion 220. One or more flow channels 212 may extend axially through the first portion 210 of the lower cap 200. The flow channels 212 of the lower cap 200 may be in fluid communication with the flow channels 120 of the body 110.

One or more first radial ports 222 may extend radially through the second portion 220 of the lower cap 200. The first radial ports 222 may (when not covered by the sleeve 250) provide a path of fluid communication from the flow channels 212, through the lower cap 200, and to the chamber 170.

One or more second radial ports 214 may extend radially through the first portion 210 of the lower cap 200. The second radial ports 214 may provide a path of fluid communication from the chamber 170, through the lower cap 200, and to the exterior of the body 110.

Referring now to FIGS. 1 through 8, in operation, the underreamer 100 is run into the wellbore 190 by a work/drill string (not shown) coupled to the first end portion 112 thereof. The underreamer 100 may be in the retracted state as it is run into the wellbore 190, as shown in FIGS. 1 through 3.

When the underreamer 100 is positioned at the desired depth to enlarge the diameter of the wellbore 190, the pressure of the fluid downhole in the wellbore 190 is increased from the surface. For example, mud/drilling fluid may be pumped from surface down through the drill string, through the one or more flow channels 120 extending axially through the body 110 of underreamer 110 and through flow channels 212 of the lower cap 200. To actuate the cutter blocks 130 from the retracted state to the expanded state, the sleeve 250 moves or slides axially with respect to the lower cap 200 (and the body 110) to uncover the radial ports 222 in the lower cap 200 to provide a path of fluid communication therethrough. The sleeve 250 may be moved via electrical actuation, mechanical actuation, hydraulic actuation, or the like. For example, the sleeve 250 may be spring biased (not shown but such arrangement well known to those skilled in the art) such that the sleeve 250 moves downhole in response to increased fluid pressure downhole of flow channels 212. In such example, when the downhole pressure subsides, the spring biases the sleeve 250 in the uphole direction to return the sleeve 250 to its original position. In one implementation, the sleeve 250 may move toward the second end portion 114 of the body 110, thereby uncovering the radial ports 222 in the lower cap 200. In another implementation, the sleeve 200 may move to align one or more ports (not shown) formed through the sleeve 250 with the radial ports 222 in the lower cap 200. In yet another implementation, the sleeve 250 may not be present, thereby causing the radial ports 222 to be unobstructed.

Once the sleeve 250 has been moved (or if the sleeve 250 is not present), the pressurized fluid in the wellbore 190 may flow through the flow channels 120 in the body 110, the flow channels 212 in the lower cap 200, the radial ports 222 in the lower cap 200, and into the chamber 170. As the pressure of the fluid in the chamber 170 increases, the pressurized fluid exerts a force on the drive piston 172 that moves the drive piston 172 axially toward the first end portion 112 of the body 110.

The movement of the drive piston 172 exerts a force on the drive ring 174 that moves the drive ring 174 axially toward the first end portion 112 of the body 110. The movement of the drive ring 174 exerts a force on the cutter blocks 130 that simultaneously moves the cutter blocks 130 axially toward the first end portion 112 of the body 110 and radially outward (e.g., at an angle between about 15° and about 25° with respect to the longitudinal axis through the body 110).

The movement of the cutter blocks 130 exerts a force on the stop ring 164 that moves the stop ring 164 axially toward the first end portion 112 of the body 110, which compresses the spring 160. When the stop ring 164 contacts a shoulder in the body 110 and/or the spring retainer 162, the stop ring 164 halts or prevents further movement of the cutter blocks 130. At this point, the cutter blocks 130 are in the expanded state and may contact or already be in contact with the wall 192 of the wellbore 190 to increase the diameter thereof (see FIGS. 4 and 5)

To deactuate the cutter blocks 130 from the expanded state back to the retracted state, the sleeve 250 moves or slides axially with respect to the lower cap 200 (and the body 110) to cover the radial ports 222 in the lower cap 200, thereby preventing fluid flow therethrough. Once the ports 222 have been covered or blocked (i.e., by moving sleeve 250 to cover the ports 222), the pressure of the fluid in the chamber 170 may decrease. For example, a portion of the fluid in the chamber 170 may gradually flow through the radial ports 214 in the lower cap 200 (and the nozzle 238 in the body 110) and to the exterior of the body 110, thereby decreasing the pressure of the fluid in the chamber 170. Also, the fluid flow pumped from surface down through the drill string may be decreased or stopped, such that the fluid pressure in chamber 170 is sufficiently decreased to permit the cutter blocks 130 to retract back to their retracted state.

As the pressure of the fluid in the chamber 170 decreases, the force exerted on the drive piston 172 and, thus, the drive ring 174 toward the first end portion 112 of the body 110 decreases. When this force becomes less than an opposing force exerted on the stop ring 164 by the compressed spring 160 (toward the second end portion 114 of the body 110), the spring 160 may move the stop ring 164 toward the second end portion 114 of the body 110. The stop ring 164 may, in turn, move the cutter blocks 130. The cutter blocks 130 may move simultaneously or one by one toward the second end portion 114 of the body 110 and radially inward (e.g., at an angle between about 15° and about 25° with respect to the longitudinal axis through the body 110) until the cutter blocks 130 are once again in the retracted state (see FIGS. 1-3).

As discussed above, the cutter blocks 130 may be significantly extended beyond the outer surface 116 of the body 110 (e.g., the ratio of the distance 144 to the diameter 118 may be as much as 0.50:1 or more). To facilitate retaining the cutter blocks 130 movably coupled to the body 110 when the cutter blocks 130 are extended, one or more implementations hereinafter described may be employed.

Figure 9:
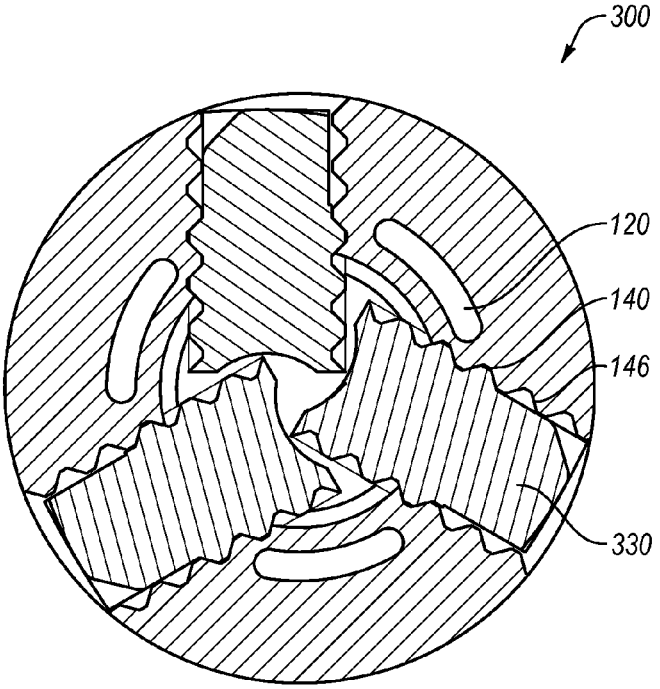
FIG. 9 depicts a cross-section view of an underreamer with offset cutter pockets with the cutter blocks in a retracted position, according to one or more embodiments.
Figure 10:
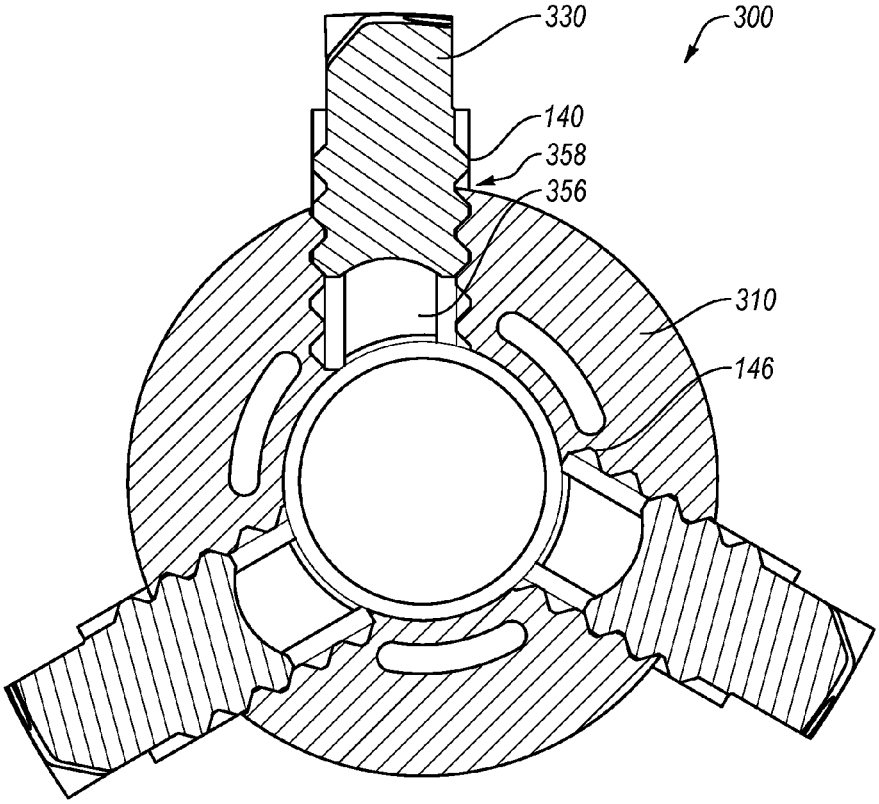
FIG. 10 depicts a cross-section view of the underreamer of FIG. 9 with the cutter blocks in the expanded position, according to one or more embodiments.

As illustrated in FIG. 9, the underreamer 300 has cutter blocks 330, which are disposed in offset cutter pockets 356 circumferentially spaced around the body 310. The offset cutter pockets 356 are formed when the cutter pockets are offset or out of radial alignment with a center axis running through the center of the underreamer 300. The embodiment shown in FIG. 9 does not have a mandrel 122 centered in the body; however, those skilled in the art will appreciate that such a mandrel 122 may be so disposed. The lack of a mandrel 122 may permit the cutter blocks 330 to have an additional radial length. While the underreamer 300 of FIG. 9 is illustrated with its cutter blocks 330 in the retracted position, FIG. 10 illustrates the cutter blocks 330 in their expanded position. Because the cutter pockets 356 are offset from each other, a side portion 358 of the cutter pocket 356 has an additional contact or engagement length with a side portion of cutter block 330. This additional contact or engagement length facilitates the retention of the cutter block 330 within the cutter pocket 356 and movably coupled to the body 310. This additional contact or engagement length includes additional contact or engagement length between the splines 140 of the cutter blocks 330 and the corresponding grooves 146 of the body 310 (i.e., inner surface of the cutter pocket 356), which facilitate cutter block 330 retention. Thus, the offset cutter pockets 356 act as a retainer to retain the cutter blocks 330 movably coupled to body 310.

Figure 11:
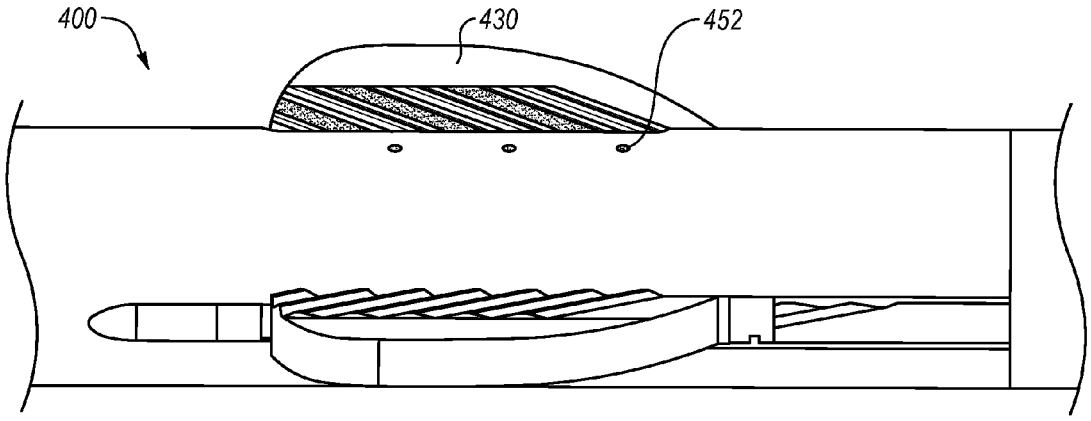
FIG. 11 depicts a side view of an underreamer, according to one or more embodiments, in which the cutter blocks are movably coupled and retained with the underreamer body via the engagement of pins within pin grooves.
Figure 12:
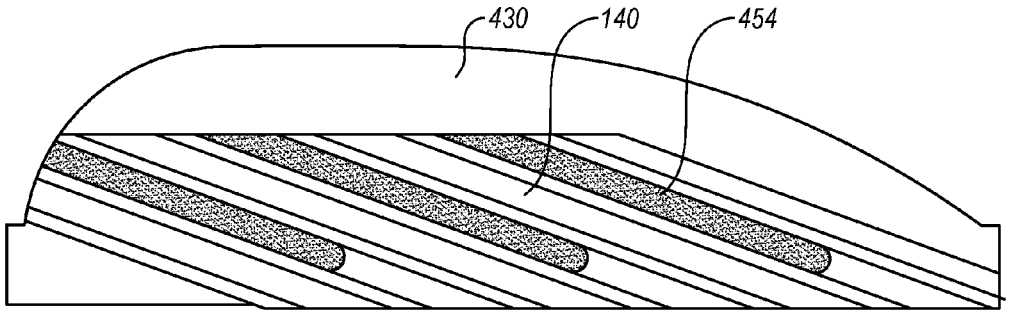
FIG. 12 depicts a more detailed side view of the cutter block of FIG. 11.

As illustrated in FIG. 11, the underreamer 400 also has cutter blocks 430 moveably coupled to the body 110 thereof. In addition to the splines or extensions 140 disposed on a side portion of the cutter blocks 430, pin grooves 454 are also disposed therein. FIG. 12 illustrates in more detail the pin grooves 454 disposed in the side portion of the cutter blocks 430. The pin grooves 454 are arranged to receive pins 452 which are disposed through the outer surface 116 of the body 110. As the cutter blocks 430 move radially outward and axially due to the sliding engagement of splines 140 within grooves 146, the pins 452 move within and are retained by the pin grooves 454 having a finite length. When fully extended, the cutter block 330 is retained by pin 454 disposed in an end portion of groove 454. FIGS. 11 and 12 illustrate the pins 452 and pin grooves 454 on one side portion of the cutter blocks 430; however, those skilled in the art will readily recognize that the pins 452 and grooves 454 may be disposed on both side portions of the cutter blocks 430. Thus, the pins 452 and grooves 454 act as a retainer to retain the cutter blocks 430 movably coupled to body 110.

Figure 13:
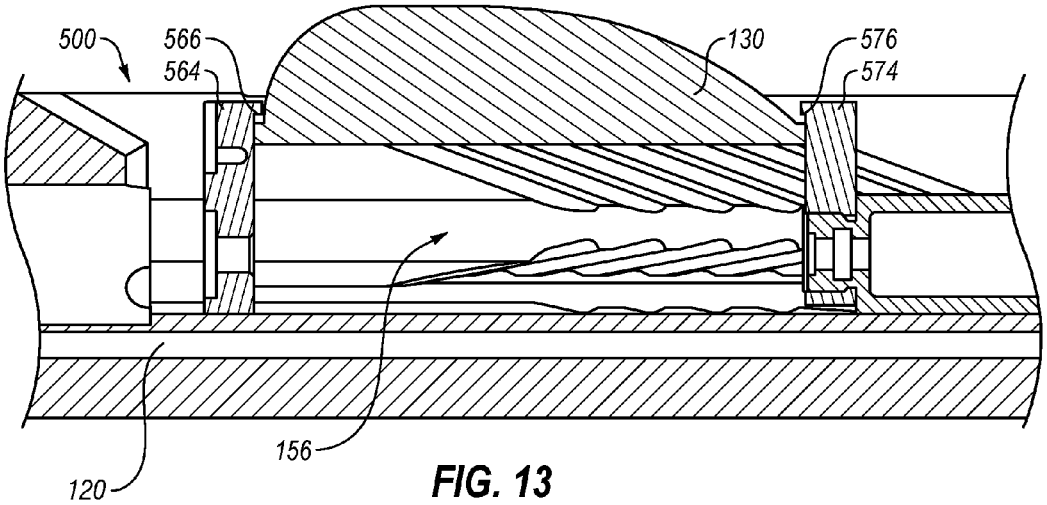
FIG. 13 depicts a cross section view of an underreamer, according to one or more embodiments, having stop and drive rings each having lips or ledges arranged to retain the cutter block with the underreamer body when the cutter block is in the expanded position.

As illustrated in FIG. 13, the underreamer 500 has cutter blocks 130, which are retained in their respective cutter pockets 156 by modified stop rings 564 and drive rings 574. As shown, stop ring 564 has a ledge or lip 566 that is arranged to retain a portion of the cutter block 130 when the cutter block is fully extended. Similarly, drive ring 574 has a ledge or lip 576 that is arranged to retain another portion of the cutter block 130 when the cutter block is fully extended. While modifications (e.g., lips/ledges 566, 576) are shown to stop ring 564 and drive ring 574, those skilled in the art will readily recognize that only one or the other modification need be made to retain the cutter block 130 within the cutter pocket 156 and movable coupled to the body 110. Thus, the lips/ledges 566, 576 of the stop ring 564 and drive ring 574, respectively, each act as a retainer to retain the cutter blocks 130 movably coupled to body 110.

Figure 14:
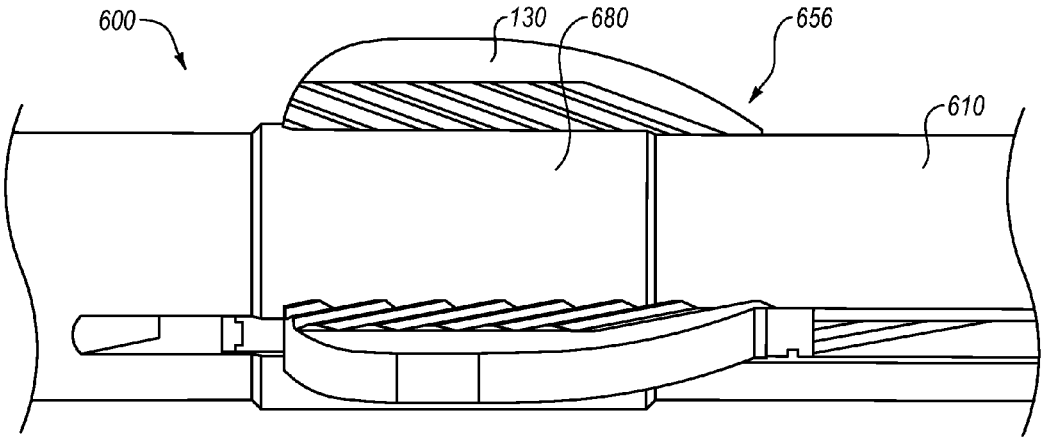
FIG. 14 depicts a side view of an underreamer, according to one or more embodiments with an upset in the underreamer body proximate the cutter blocks.

As illustrated in FIG. 14, the underreamer 600 may have a body 610 with an upset 680 positioned proximate the cutter blocks 130 or cutter pockets 656. Similar to the underreamer 300 of FIGS. 9 and 10, the upset 680 of FIG. 14 provides an additional radial distance of the body 610 in which the cutter block 130 may engage or contact cutter pocket 656 of body 610 when the cutter block 130 is fully or extended. This additional contact or engagement length facilitates the retention of the cutter block 130 within the cutter pocket 656 and movably coupled to the body 610. This additional contact or engagement length includes additional contact or engagement length between the splines 140 of the cutter blocks 130 and the corresponding grooves 146 of the body 610 (i.e., inner surface of the cutter pocket 656), which facilitate cutter block 130 retention. Thus, the upset 680 acts as a retainer to retain the cutter blocks 130 movably coupled to body 610.

While several implementations for retaining the cutter blocks moveably disposed with the underreamer body are described above, those skilled in the art will readily recognize that one or more of these retention devices may be employed in combination to better retain the cutter blocks while in their fully or near fully extended position.

As used herein, the terms "inner" and "outer"; "up" and "down"; "upper" and "lower"; "upward" and "downward"; "above" and "below"; "inward" and "outward"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via another element or member." The terms "hot" and "cold" refer to relative temperatures to one another.

Although only a few example implementations have been described in detail above, those skilled in the art will readily appreciate that many modifications are possible in the example implementations without materially departing from "Underreamer for Increasing a Wellbore Diameter." Accordingly, all such modifications are intended to be included within the scope of this disclosure. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures.

What is claimed is:

1. An underreamer for increasing a diameter of a bore, comprising:

a substantially cylindrical body;

a cutter block movably coupled to the body, wherein a ratio of a height of the cutter block to an outer diameter of the body is between about 0.35:1 and about 0.50:1;

a piston within the body and arranged and designed to move the cutter block in response to fluid pressure within a chamber in the body;

a mandrel extending axially through the body from a position above the cutter block to a position below the cutter block; and a flow channel extending through the body from a position above the cutter block to a position below the cutter block and below the piston, the flow channel being radially between the mandrel and an outer surface of the body, the flow channel being in fluid communication with the chamber through a flow path that extends at least partially radially inward from the flow channel toward the chamber.

2. The underreamer of claim 1, wherein the height of the cutter block is measured from a radially inner surface of the cutter block to a radially outer surface of the cutter block.

3. The underreamer of claim 1, wherein the flow channel includes inner and outer radial surfaces both disposed radially between the mandrel and an outer surface of the body.

4. The underreamer of claim 1, wherein the flow channel is circumferentially offset from the cutter block.

5. The underreamer of claim 1, wherein the flow channel has a cross-sectional area between about 1 $cm^2$ and about 15 $cm^2$.

6. The underreamer of claim 1, wherein the flow channel is a plurality of flow channels each having a cross sectional area, and wherein a sum of the cross sectional areas of the plurality of flow channels is between about 3 $cm^2$ and about 45 $cm^2$.

7. The underreamer of claim 1, wherein an outer surface of the cutter block is positioned radially inward from or radially aligned with an outer surface of the body when the cutter block is in a retracted state, and wherein the outer surface of the cutter block is positioned radially outward from the outer surface of the body by a distance when the cutter block is in an expanded state.

8. The underreamer of claim 7, wherein a ratio of the distance to the diameter of the body is between about 0.10:1 and about 0.35:1.

9. The underreamer of claim 8, wherein the underreamer is adapted to increase the diameter of the wellbore by between about 30% and about 70% when the cutter block is in the expanded state.

10. The underreamer of claim 7, wherein a ratio of the distance to the diameter of the body is between about 0.40:1 and about 0:50:1.

11. The underreamer of claim 7, wherein a ratio of the distance to the diameter of the body is greater than about 0.35:1.

12. The underreamer of claim 1, wherein a portion of the mandrel positioned radially inward from the cutter block is solid with no bore therethrough, and wherein a ratio of an outer diameter of the portion of the mandrel positioned radially inward from the cutter block to the diameter of the body is between about 1:5 and about 1:20.

13. The underreamer of claim 1, wherein a retainer maintains the cutter block movably coupled to the body when the cutter block is in its expanded state.

14. The underreamer of claim 1, the cutter block including a plurality of cutter blocks in corresponding pockets in the body, and wherein the flow channel is a plurality of flow channels, each of the plurality of flow channels being circumferentially offset from each pocket of the plurality of pockets and each cutter block of the plurality of cutter blocks.

15. The underreamer of claim 14, wherein the plurality of flow channels extend axially from a position above the plurality of cutter blocks to a position below the cutter blocks, the plurality of flow channels defining a flow path configured to receive a full amount of fluid flowing through the body past the plurality of cutter blocks.

16. The underreamer of claim 14, the plurality of cutter blocks being axially aligned and circumferentially offset with each other, and the plurality of flow channels being axially aligned and circumferentially offset with each other, at least a portion of a length of the plurality of flow channels further being axially aligned with the plurality of cutter blocks.

17. An underreamer for increasing a diameter of a bore, comprising:

a substantially cylindrical body, wherein a flow channel extends at least partially axially through the body;

a mandrel extending axially through the body, wherein the mandrel is solid and has no axial bore therethrough, and wherein the flow channel is disposed radially between the mandrel and an outer surface of the body; and a cutter block movably coupled to the body, the cutter block having an outer surface positioned radially inward from or radially aligned with the outer surface of the body when the cutter block is in a retracted state, the outer surface of the cutter block positioned radially outward from the outer surface of the body by a distance when the cutter block is in an expanded state, wherein a ratio of a height of the cutter block to a diameter of the body is between about 0.35:1 and about 0.50:1.

18. The underreamer of claim 17, wherein a ratio of the distance to the diameter of the body is between about 0.10:1 and about 0.35:1.

19. The underreamer of claim 17, wherein the flow channel is circumferentially offset from the cutter block.

20. The underreamer of claim 17, wherein the flow channel is a plurality of flow channels each having a cross sectional area, and wherein a sum of the cross sectional areas of the plurality of flow channels is between about 3 $cm^2$ and about 45 $cm^2$.

21. The underreamer of claim 17, wherein the underreamer is adapted to increase the diameter of the wellbore by between about 30% and about 70% when the cutter block is in the expanded state.

22. The underreamer of claim 17, wherein a retainer maintains the cutter block movably coupled to the body when the cutter block is in its expanded state.

23. A method for increasing a diameter of a bore, comprising:

running an underreamer into a bore, the underreamer including a substantially cylindrical body having a mandrel and a flow channel extending at least partially axially therethrough, the flow channel being disposed radially between the mandrel and an outer surface of the body, the underreamer further including a cutter block movably coupled to the body;

flowing a fluid through the flow channel and into a chamber disposed radially between the mandrel and the outer surface of the body, wherein flowing the fluid includes moving a sleeve disposed radially outward from the chamber to form a path of fluid communication between the flow channel and the chamber;

increasing a pressure of the fluid;

moving the cutter block from a retracted state to an expanded state, the cutter block having an outer surface positioned radially inward from or radially aligned with the outer surface of the body when the cutter block is in the retracted state, the outer surface of the cutter block positioned radially outward from the outer surface of the body by a distance when the cutter block is in the expanded state, wherein a ratio of a height of the cutter block to a diameter of the body is between about 0.35:1 and about 0.50:1; and increasing the diameter of the bore with the cutter block when the cutter block is in the expanded state.

24. The method of claim 23, wherein the cutter block moves from the retracted state to the expanded state in response to the increased pressure of the fluid.

25. The method of claim 23, where the underreamer further comprises a retainer to maintain the cutter block movably coupled to the body when the cutter body is in its expanded state.

* * * * *